US010883786B2

(12) United States Patent
Reilly

(10) Patent No.: US 10,883,786 B2
(45) Date of Patent: Jan. 5, 2021

(54) SUB-MASS PROJECTILE FOR A FIREARM

(71) Applicant: William D. Reilly, Clearfield, UT (US)

(72) Inventor: William D. Reilly, Clearfield, UT (US)

( * ) Notice: Subject to any disclaimer, the term of this patent is extended or adjusted under 35 U.S.C. 154(b) by 0 days.

(21) Appl. No.: 15/453,960

(22) Filed: Mar. 9, 2017

(65) Prior Publication Data

US 2017/0234665 A1 Aug. 17, 2017

Related U.S. Application Data

(63) Continuation of application No. PCT/US2015/056118, filed on Oct. 18, 2015.

(51) Int. Cl.

| | |
|---|---|
| ***F41A 21/26*** | (2006.01) |
| ***F42B 12/78*** | (2006.01) |
| ***F42B 14/00*** | (2006.01) |
| ***F41A 9/38*** | (2006.01) |
| ***F42B 12/74*** | (2006.01) |

(52) U.S. Cl.

CPC ..... *F41A 21/26* (2013.01); *F41A 9/38* (2013.01); *F42B 12/74* (2013.01); *F42B 12/745* (2013.01); *F42B 12/78* (2013.01); *F42B 14/00* (2013.01)

(58) Field of Classification Search

CPC ..... F42B 14/00; F42B 14/064; F42B 12/74; F42B 12/745; F42B 12/78; F42B 12/00; F41A 9/38; F41A 21/26

See application file for complete search history.

(56) References Cited

U.S. PATENT DOCUMENTS

| | | | | |
|---|---|---|---|---|
| 1,053,845 A * | 2/1913 | Mauser | F42B 12/74 | 102/516 |
| 2,345,089 A | 3/1944 | Born | | |
| 2,986,091 A * | 5/1961 | Ferguson | F42B 8/16 | 102/529 |
| 2,991,718 A * | 7/1961 | Ferguson | F42B 8/16 | 102/529 |
| 3,363,509 A * | 1/1968 | Tschoepe | F41A 21/26 | 89/14.5 |
| 3,418,741 A * | 12/1968 | Tschoepe | F41A 11/02 | 42/77 |
| 3,785,293 A * | 1/1974 | Barr | F42B 8/16 | 102/529 |
| 3,983,820 A * | 10/1976 | Crepin | F42B 30/08 | 102/517 |
| 5,012,743 A | 5/1991 | Denis | | |
| 5,375,529 A | 12/1994 | Knight, Jr. et al. | | |

(Continued)

FOREIGN PATENT DOCUMENTS

GB 125652 A * 5/1919 ..... F41A 1/08

*Primary Examiner* — Benjamin P Lee

(74) *Attorney, Agent, or Firm* — Robert L. Lundstrom

(57) ABSTRACT

A sub-mass projectile for a firearm includes a core having a relatively lower mass than a standard projectile for the firearm. A force inducer is associated with the core. The force inducer has an interface that interacts with the firearm. The interface includes a bearing surface with a relatively larger outer diameter than a standard projectile for the firearm. The bearing surface bears against a surface of the firearm during operation so as to increase resistive forces between the sub-mass projectile and the firearm to a magnitude sufficient to approximate the kinetic forces of a standard mass projectile on the firearm during operation.

20 Claims, 5 Drawing Sheets

(56) References Cited

U.S. PATENT DOCUMENTS

| | | | | | |
|---|---|---|---|---|---|
| 5,443,011 | A * | 8/1995 | Coates | F42B 14/064 | 102/293 |
| 5,686,693 | A | 11/1997 | Jakobsson | | |
| 5,841,058 | A * | 11/1998 | Manis | F41A 1/02 | 89/8 |
| 6,286,433 | B1 * | 9/2001 | Borg | F42B 12/06 | 102/516 |
| 6,343,553 | B1 * | 2/2002 | O'Dwyer | F41A 21/06 | 102/430 |
| 6,581,522 | B1 * | 6/2003 | Julien | F42B 5/192 | 102/430 |
| 7,219,607 | B2 | 5/2007 | Oertwig | | |
| 7,607,394 | B2 | 10/2009 | Cesaroni | | |
| 8,109,212 | B2 * | 2/2012 | O'Dwyer | F42B 5/035 | 102/217 |
| 8,434,409 | B2 | 5/2013 | O'Dwyer | | |
| 8,640,623 | B2 * | 2/2014 | Eckstein | F42B 5/03 | 102/438 |
| 8,689,696 | B1 * | 4/2014 | Seeman | F42B 5/02 | 102/439 |
| 8,783,187 | B2 * | 7/2014 | Amick | F42B 30/02 | 102/517 |
| 2002/0134273 | A1 * | 9/2002 | Mihaylov | F42B 10/24 | 102/439 |
| 2014/0326156 | A1 * | 11/2014 | Flowers | F42B 12/745 | 102/439 |
| 2016/0223275 | A1 * | 8/2016 | Grant | F41A 1/10 | |
| 2016/0258726 | A1 * | 9/2016 | Sullivan | F42B 8/02 | |
| 2017/0138712 | A1 * | 5/2017 | Teig | F42B 12/74 | |

* cited by examiner

SUB-MASS PROJECTILE FOR A FIREARM

PRIORITY CLAIM

This is a continuation of International Application PCT/US2015/56118, with an international filing date of Oct. 18, 2015, which is incorporated by reference herein in its entirety.

BACKGROUND OF THE INVENTION

Field of the Invention

The present invention relates generally ammunition for firearms, and more specifically to sub-mass projectiles, such as bullets, for automatic and semi-automatic firearms.

Related Art and weight and described by the term caliber. Each caliber of ammunition has a minimum and maximum standard for projectile mass which is generally measured in terms of "grains". Additionally, each caliber size of ammunition has a propellant charge sized to correspond to projectile mass, within the minimum and maximum standards, thereby creating a spectrum of mass for which proper function and operation of the firearm is maintained. Use of a projectile that is below the minimum standard for projectile mass presents significant problems in operation, accuracy, and loading action for firearm weapons in general without additional mechanical or manual intervention, and has not been successfully realized for automatic and semi-automatic loading firearms.

Some projectiles have been developed that have a mass below the minimum standard of the mass tolerance band. Such projectiles are used primarily in single shot training and non-lethal ammunition applications. For example wax, ink marking materials, rubber and plastic projectiles have all been developed to serve as below mass ammunition. Unfortunately, to compensate for the lack of mass needed to operate the action of the firearm, such ammunition requires additional manipulation of the firearm system, such as mechanized cartridge cases including telescopic extensions, sliding pistons, multiple primer systems or pressurized gas within the cartridge, or increased charge within the cartridge to an overpressure or +P charge.

Additionally, operation of a firearm with currently known sub-mass projectiles often involves the modification of the firearm spring, slide or barrel. Hence, projectiles that correspond with mechanized cartridge cases may utilize various sabot configurations as a delivery system, or add high density metal powder to form a seal around the projectile to operate the loading action of the firearm. It is important to note that these usages are primarily limited to law enforcement and the military.

Cartridge and firearm modifications for known sub-mass projectiles are only utilized by the projectiles for which they were designed and are not interchangeable with other cartridges, firearms, or ammunition. Moreover no known sub-mass projectile operates independent of externally applied forces, via the cartridge and firearm modifications, that compensates for the lack of mass needed to operate the loading action of the firearm. Some sub-mass projectiles including wax, ink marking materials, rubber and plastic bullets have been used in auto loading firearms, however, the auto loading action must be manually operated after firing each cartridge.

SUMMARY OF THE INVENTION

Because of the limitations of the prior art, the inventor of the present invention has recognized that it would be advantageous to develop a sub-mass projectile that is below the minimum tolerance of the standard mass of the projectile for which the firearm mechanism was designed. Additionally, the inventor has recognized that it would be advantageous to develop a sub-mass projectile with a contact surface sized and shaped to increase forces between the sub-mass projectile and the firearm in order to compensate for the lack of mass and operate the auto loading action of the firearm. Moreover, the inventor has recognized that it would be advantageous to develop a sub-mass projectile system for a firearm that can be customized with respect to desired operational performance characteristics of the sub-mass projectile such as projectile velocity, penetration, accuracy and the like.

The invention provides for a sub-mass projectile for a firearm including a core having a relatively lower mass than a standard projectile for the firearm. A force inducer can be associated with the core. The force inducer can have an interface that can interact with the firearm.

In one embodiment, the interface can include a bearing surface with a relatively larger outer diameter than a standard projectile for the firearm. The bearing surface can bear against a surface of the firearm during operation so as to increase resistive forces between the sub-mass projectile and the firearm to a magnitude sufficient to approximate the kinetic forces of a standard mass projectile on the firearm during operation.

In another embodiment, the interface can include a bearing surface that can form a seal between the sub-mass projectile and the firearm to keep combustion gasses from discharge of the firearm downstream of the sub-mass projectile until sufficient pressure is reached to overcome the increased resistive forces of the bearing surface on the firearm, and the sub-mass projectile is subsequently expelled from the firearm.

The invention also provides for an ammunition system for a firearm including a sub-mass projectile having a relatively lower mass than a standard projectile for the firearm. The sub-mass projectile can have a nose disposed on a forward end of the sub-mass projectile, a base disposed on a rearward end of the sub-mass projectile, and a sidewall extending between the nose and the base. A bearing surface of the projectile can be disposed on at least a portion of the sidewall. The bearing surface can be configured to engage with a portion of the firearm when the firearm is discharged to create resistive forces on the firearm of sufficient magnitude to approximate the recoil forces of a standard firearm projectile on the firearm during operation. A cartridge can be sized and shaped to hold the sub-mass projectile and together the cartridge and sub-mass projectile can be sized to fit within the loading action of the firearm. An energetic material can be disposed in the cartridge adjacent the base of the sub-mass projectile. The energetic material can be configured to release propulsive energy to the sub-mass projectile when the firearm is discharged.

In another embodiment, the present invention also provides for a firearm system including a standard firearm configured to fire standard size and mass projectiles per a pre-determined caliber of the firearm. An ammunition system can operably engage with the firearm to shoot sub-mass projectiles. The ammunition system can include a core having a relatively lower mass than a standard projectile for the firearm, and a bearing surface associated with the core.

The bearing surface can have a relatively larger outer diameter than an outer diameter of a standard projectile for the firearm. The bearing surface can also be sized and shaped to increase resistive forces between the sub-mass projectile and the firearm, and to seal the firearm to allow pressure from discharge gasses to increase in the firearm until the pressure overcomes the resistive forces and the sub-mass projectile is expelled from the firearm.

Additional features and advantages of the invention will be apparent from the detailed description which follows, taken in conjunction with the accompanying drawings, which together illustrate, by way of example, features of the invention.

DETAILED DESCRIPTION

Figure 1:
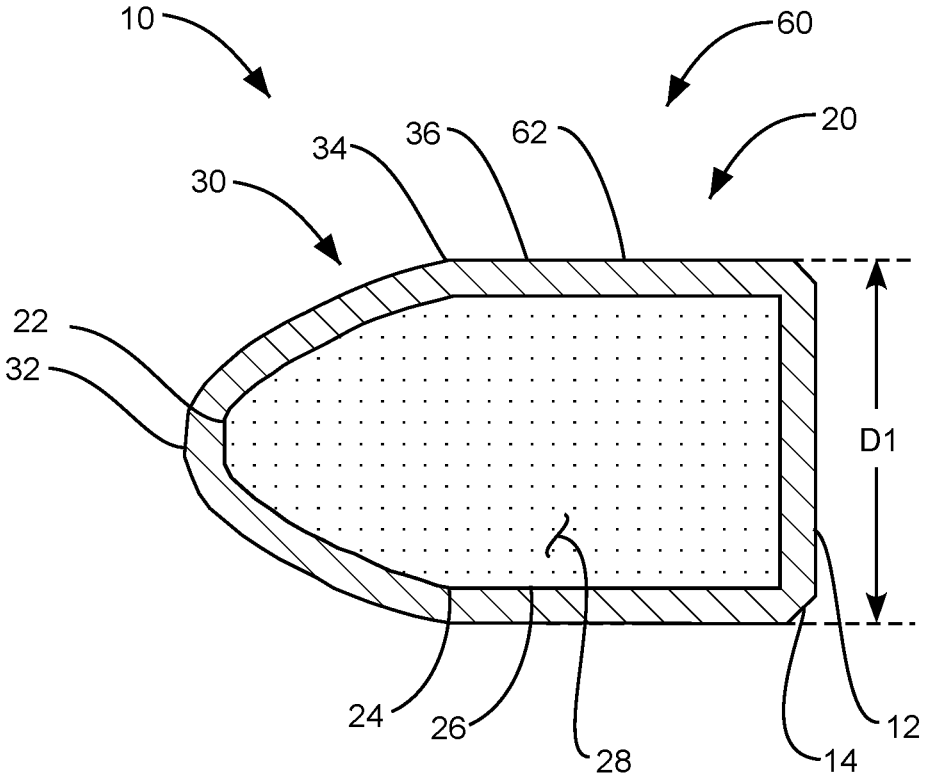
FIG. 1 is a cross sectional view of a sub-mass projectile for use as ammunition in a firearm in accordance with an embodiment of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

The present invention provides generally for an ammunition system for a firearm. The ammunition system can include a sub-mass projectile that has a mass that is relatively lower than the mass of a standard projectile for the firearm. The sub-mass projectile can include a force inducer that creates and introduces forces in the firearm during operation of the firearm that approximate the operational forces of the firearm when the firearm discharges a projectile having a standard mass. The force inducer can include an interface that interacts with the firearm. The interface can have physical properties that can introduce forces, including resistive forces such as friction and drag, into the firearm. The forces induced in the firearm can have sufficient magnitude to approximate the operational forces on a firearm when ammunition with a standard projectile is discharged in the firearm.

In one aspect, the forces include a resistive, frictional force between the sub-mass projectile and the firearm that approximates the forces needed by the firearm to actuate automatic and semi-automatic loading actions of the firearm such that the firearm can repeat load and fire sequences as with standard ammunition in an automatic or semi-automatic firearm. Hence, the sub-mass projectile can have dimensional properties, material properties, or combinations of dimensional and material properties that produce the required forces on the firearm so as to approximate the operational forces of the firearm when the firearm is discharged with a projectile of standard mass and size. In this way, the present invention maintains performance of the firearm by trading mass of the bullet or projectile with physical dimensions of the projectile that introduce sufficient forces to the firearm to approximate the operation of a relatively larger mass projectile within the chamber and barrel of the firearm. Thus, the lighter mass of the sub-mass projectile is compensated for by increasing the overall dimensions of the bullet. In this way, the sub-mass projectile of the present invention can operate with a firearm without modification of the firearm, or charge and cartridge of the ammunition.

Moreover, the mass and diameter of the sub-mass projectile can be adjusted to customize performance of the sub-mass projectile. For example, if greater projectile penetration is desired, then the mass can be closer to the mass of a standard projectile while the outer diameter of the sub-mass projectile is also closer to the outer diameter of a standard mass projectile. Whereas if less projectile penetration is desired, then the mass of the sub-mass projectile can be significantly less than the mass of standard projectile while the outer diameter of the sub-mass projectile is increased to compensate for the lower mass of the projectile in the firearm. Thus, greater mass of the sub-mass projectile means smaller outer diameter, while smaller mass means greater outer diameter.

A sub-mass ammunition system as described herein presents many advantages over current standard mass ammunition. For example, sub-mass materials combined with adjusted projectile dimensions can result in: full functioning of auto and semi-auto loading actions of firearms, reduction in felt recoil energy, increased penetration and velocity control, increased accuracy, increased kinetic energy impact control, decreased projectile penetration depth, environmentally safer materials, and reduced cost, to name a few.

Figure 2:
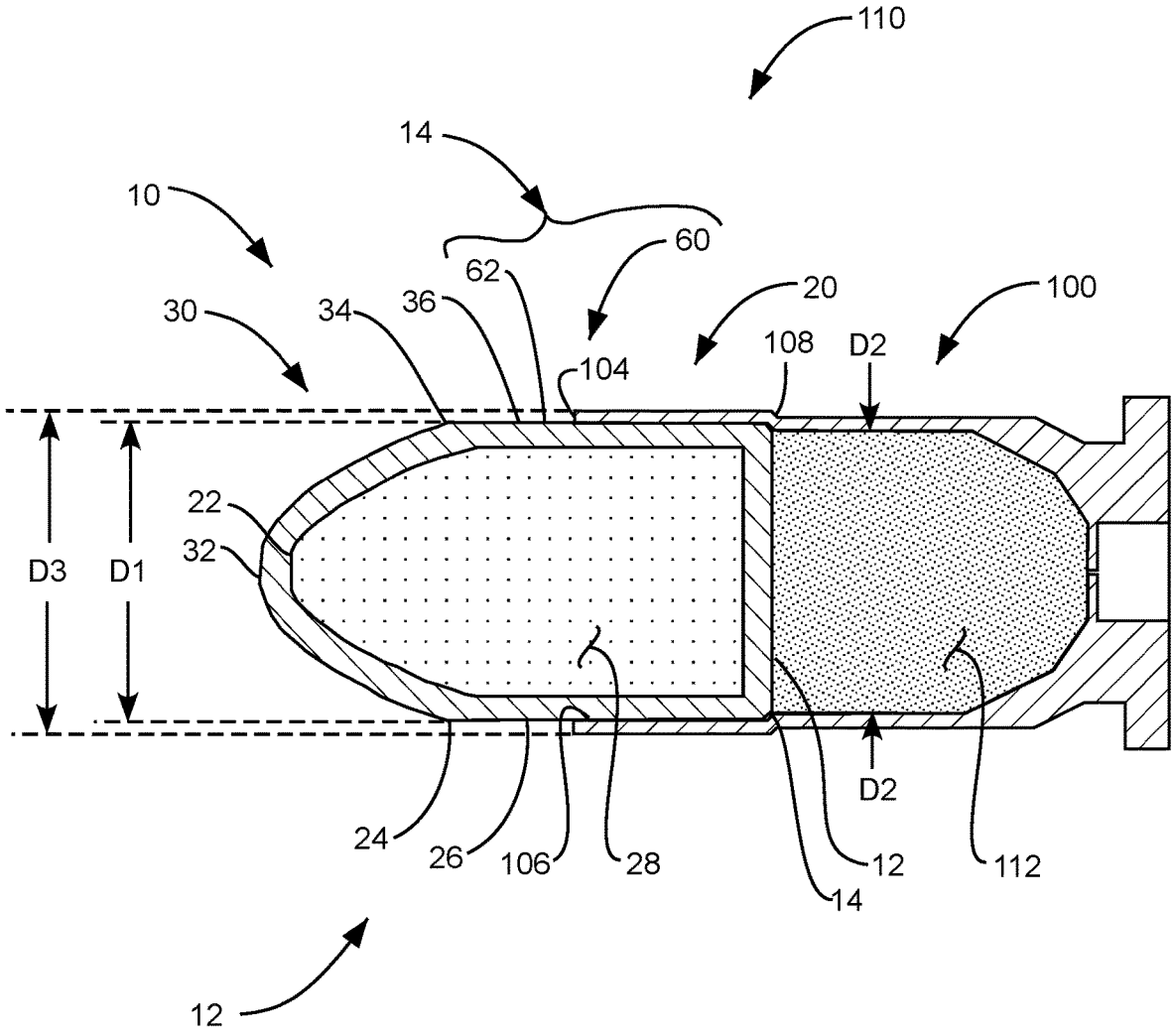
FIG. 2 is a cross sectional view of the sub-mass projectile of FIG. 1 coupled to a cartridge.

Accordingly, as illustrated in FIGS. 1-2, a sub-mass projectile system, indicated generally at 10, is shown in accordance with an embodiment of the present invention for use as ammunition for firearm weapons. The projectile 10 can include a core, indicated generally at 20, and a jacket, indicated generally at 30. Together the core 20 and jacket 30 form a force inducer, indicated generally at 12. Additionally, the sub-mass projectile 10 can be sized and shaped to fit into a standard cartridge, indicated generally at 100, to form an ammunition system, indicated generally at 110, that is usable in the firearm without modification of the firearm.

The core 20 can be generally shaped as a bullet or slug as known in the art. Hence, the core 20 can have a conically shaped nose 22 extending rearward to a shoulder 24 that can transition into a cylindrically shaped body 26. The core 20 can be sized and shaped to fit in a predetermined caliper firearm.

It will be appreciated that the embodiments of the invention described herein can apply to all known calipers of ammunition and, for purposes of description, the figures are drawn only generally without regard to a specific caliper and size. Additionally it will be appreciated that the inventive concepts of the present invention can be applied to all types of projectiles including hollow point, full metal jacket, open tip, soft point, ballistic tip, frangible, armor piercing, tracer, and the like, as known in the art.

The core 20 can include a low mass material 28 that can be a malleable material. The low mass material 28 can have a relatively lower mass than material used in a standard projectile for the firearm which results in a corresponding lower density and weight. In one aspect, the sub-mass projectile of the present invention can have a weight ranging from approximately 70% to 30% of the weight of the standard projectile. Thus, by way of example, a standard 9 mm caliber projectile may have a minimum weight of 5.8 g (90 grain). In contrast, the weight of a 9 mm caliber sub-mass projectile as described herein can have a weight between 1.7 g (27 grain) and 4.1 g. Also by way of example only, and not for purposes of limiting the scope of the present invention, table 1 below indicates the corresponding weight ranges of sub-mass projectiles as described herein of many of the more common calibers of ammunition as compared to weights of standard projectiles of the respective calibers. Other calibers not listed in table 1 can also benefit from the inventive concepts of the present invention. Advantageously, the actual weight of a sub-mass projectile can be selected by the user based on desired operational performance characteristics of the projectile, such as projectile velocity, penetration depth, accuracy, felt recoil, auto-loading actuation, and the like.

TABLE 1

Examples of Weight Ranges of Sub-Mass Projectiles as Compared to Standard Mass Projectiles by Caliber

| Caliber | Minimum Standard projectile Mass (Prior Art) | Minimum Sub-Mass Projectile Mass | Maximum Sub-Mass Projectile Mass |
|---|---|---|---|
| 380 Auto | 5.2 gram (g) (80 grain) | 1.6 g (24 grain) | 3.6 g (56 grain) |
| 9 mm | 5.8 g (90 grain) | 1.7 g (27 grain) | 4.1 g (63 grain) |
| 40 | 8.1 g (125 grain) | 2.4 g (37.5 grain) | 5.7 g (87.5 grain) |
| 45 ACP | 9.1 g (140 grain) | 2.7 g (42 grain) | 6.4 g (98 grain) |
| 308 | 6.5 g (100 grain) | 2.0 g (30 grain) | 4.6 g (70 grain) |
| 338 | 10.4 g (160 grain) | 3.1 g (48 grain) | 7.3 g (112 grain) |
| 375 | 10.7 g (165 grain) | 3.2 g (49.5 grain) | 7.5 g (115.5) |
| 408 | 19.8 g (305 grain) | 5.9 g (91.5 grain) | 13.9 g (213.5 grain) |
| 50 | 42 g (647 grain) | 12.6 g (194.1 grain) | 29.4 g (452.9 grain) |

The core 20 can also include materials that increase or decrease density of the core which in turn increases the malleability of the core during operation of the firearm. It will be appreciated that a less dense core can be more malleable which can result in more deformation and increased resistive forces created between the sub-mass projectile and the firearm. In contrast, a relatively denser core can be less malleable which can result in less deformation and lower resistive forces created between the sub-mass projectile and the firearm.

The sub-mass projectile can include a low mass material 28 such as wax, PVC, CPVC, ABS, polymers, esters, plastic, resin, thermoplastic, rubber, silica, glass, zirconium, diamond, polyethylene, ethylene, lime, concrete, cement, aggregate materials, metal powders, metal fragments, CO2, copper diffused ABS, and the like. The low mass material 28 of the core 20 can be selected to have a predetermined coefficient of friction with respect to ferrous materials such as steel used in gun barrels and barrel bores.

In the embodiment shown in FIGS. 1-2, the core 20 can have a jacket 30 surrounding the core. Other embodiments are contemplated that do not use a jacket 30 wherein the core 20 alone can be inserted as the bullet or slug directly into the cartridge 100 and can interface directly with the chamber and barrel of the firearm without adverse effects on either the firearm or the performance of the sub-mass projectile 10.

In the case shown in FIGS. 1-2, the jacket 30 can encompass and enclose the core 20. The jacket can have the same general bullet or slug shape of the core 20 and can include a conical nose 32, a transition shoulder 34, and a cylindrical body 36. The cylindrical body 36 can have a predetermined outer diameter D1 that is relatively larger than the outer diameter of a standard projectile for the firearm. In one aspect, the outer diameter D1 of the jacket can be sized between 0.00254 mm (0.0001") and 0.127 mm (0.005") larger than the outer diameter of a standard projectile of the firearm. In another aspect, the outer diameter D1 of the jacket can be sized larger than 0.127 mm (0.005") depending on the caliber of the firearm being used and the performance characteristics that are desired by the user.

As an example of the relatively larger outer diameter D1, a standard mass 9 mm caliber projectile may have a maximum outer diameter of 9.017 mm (0.355"). In contrast, the outer diameter of a 9 mm caliber sub-mass projectile as described herein can be between 9.019 mm (0.356") and 9.12 mm (0.359"), depending on the performance characteristics desired by the user. Again, by way of example only, and not for purposes of limiting the scope of the present invention, Table 2 below indicates the corresponding diameter ranges of many of the more common calibers of ammunition as compared to the standard dimensions of the respective calibers. Other calibers not listed in table 1 can also benefit from the inventive concepts of the present invention. Advantageously, the actual physical dimensions of a sub-mass projectile can be selected by the user based on desired operational performance characteristics of the projectile, such as projectile velocity, penetration depth, accuracy, felt recoil, auto-loading actuation, and the like.

TABLE 2

Examples of Physical Dimensions of Sub-Mass Projectiles as Compared to Standard Mass Projectiles by caliber

| Caliber | Minimum Standard projectile Diameter (Prior Art) | Minimum Sub-Mass Projectile Diameter | Maximum Sub-Mass Projectile Diameter |
|---|---|---|---|
| 380 Auto | .355 inches 9.01 mm | 0.3551 inches 9.02 mm | 0.360 inches 9.14 mm |
| 9 mm | 0.355 inches 9.01 mm | .3551 inches 9.02 mm | 0.360 inches 9.14 mm |
| 40 cal | .400 inches 10.2 mm | 0.4001 inches 10.16 mm | 0.405 inches 10.29 mm |
| 45 ACP | .451 inches | 0.4511 inches | 0.456 inches |

TABLE 2-continued

Examples of Physical Dimensions of Sub-Mass Projectiles as Compared to Standard Mass Projectiles by caliber

| Caliber | Minimum Standard projectile Diameter (Prior Art) | Minimum Sub-Mass Projectile Diameter | Maximum Sub-Mass Projectile Diameter |
|---|---|---|---|
| | 11.46 mm | 11.46 mm | 11.58 mm |
| 308 | .308 inches | 0.3081 inches | 0.313 inches |
| | 7.8 mm | 7.83 mm | 7.95 mm |
| 338 | 0.338 inches | 0.3381 inches | 0.343 inches |
| | 8.58 mm | 8.59 mm | 8.71 mm |
| 375 | 0.375 inches | 0.3751 inches | 0.380 inches |
| | 9.5 mm | 9.53 mm | 9.65 mm |
| 408 | 0.408 inches | 0.4081 inches | 0.413 inches |
| | 10.4 mm | 10.37 mm | 10.49 mm |
| 50 Cal | .510 inches | 0.5101 inches | 0.515 inches |
| | 13.0 mm | 12.96 mm | 13.08 mm |

Additionally, the jacket 30 can include a malleable material such as copper, brass, lead, tin, aluminum, ABS, PVC, acrylic, resin, plastic, and the like. The material of the jacket 30 can be selected to have a predetermined hardness and coefficient of friction with respect to ferrous materials such as steel used in gun barrels and barrel bores so as to contribute to the increased resistive forces of the sub-mass projectile and core on the firearm.

It will be appreciated that an oversized diameter of a standard mass projectile has generally historically resulted in misfire or bullet jamming of the firearm, at times with catastrophic effect. For this reason, oversizing the outer diameter of a projectile is not advised in the firearms arts without significant modification of the firearm, the charge, cartridge, or combinations of these modifications.

In contrast, the unique sub-mass projectile 10 of the present invention allows for and even improves performance when the outermost diameter D1 is oversized and has an increased interference fit with the chamber and barrel of the firearm. In fact, the combination of lower mass and larger outer diameter advantageously allow the sub-mass projectile 10 of the present invention to be shot out of a firearm with relatively less felt recoil and greater accuracy than when a standard mass projectile is fired from the gun.

Turning to the cartridge 100, as best seen in FIG. 2, the cartridge 100 can be a standard cartridge that is used with standard mass projectiles for the firearm. It is a particular advantage of the present invention that standard cartridges 100 do not need any modification to be used with the sub-mass projectile 10 of the present invention. The standard cartridge 100 has an inner surface 106 with an inner diameter D2 that is approximately equal to the outer diameter of a standard mass projectile.

It will be appreciated that since the sub-mass projectile 20 can have a relatively larger outer diameter D1 than a standard projectile, then the outer diameter D1 of the sub-mass projectile may also be relatively larger than the mating inner diameter D2 of the standard cartridge 100.

Hence, when a sub-mass projectile 10 is inserted into the cartridge 100, the wall 108 of the cartridge may slightly deform, as shown at 108, to accommodate the larger outer diameter D1 of the sub-mass projectile 100, resulting in a new outer diameter D3 of the cartridge 100. Depending on the size selected for the outer diameter D1 of the sub-mass projectile 10, the deformation 108 caused on the cartridge 100 by the sub-mass projectile 10 resulting in the new outer diameter D3 may or may not be visually detectable. The new outer diameter D3 of the cartridge 100 can fit within the barrel bore 202 and the forward end 104 of the cartridge 100 can rest against the barrel stop 206 (see FIGS. 6-7). Additionally, because of the diameter interferences between the sub-mass projectile 10 and the cartridge 100, for assembly purposes, the rearward end 12 of the sub-mass projectile 10 can have a beveled edge 14 for ease of insertion into the cartridge 100.

A bearing surface, indicated generally at 60, can be associated with the core 20. As shown in FIGS. 1-2, the bearing surface 60 can be an outer surface 62 of the sub-mass projectile disposed on the outer cylindrical body 36 of the jacket 30 indicated as diameter D1. In other embodiments (not shown), the bearing surface 60 can be an outer surface of the core 20 when the sub-mass projectile does not have a jacket 30 encompassing the core. The bearing surface 60 can be sized and shaped to contact a corresponding surface of the firearm, such as the barrel or barrel bore, during discharge of the sub-mass projectile 10 from the firearm.

Figure 3:
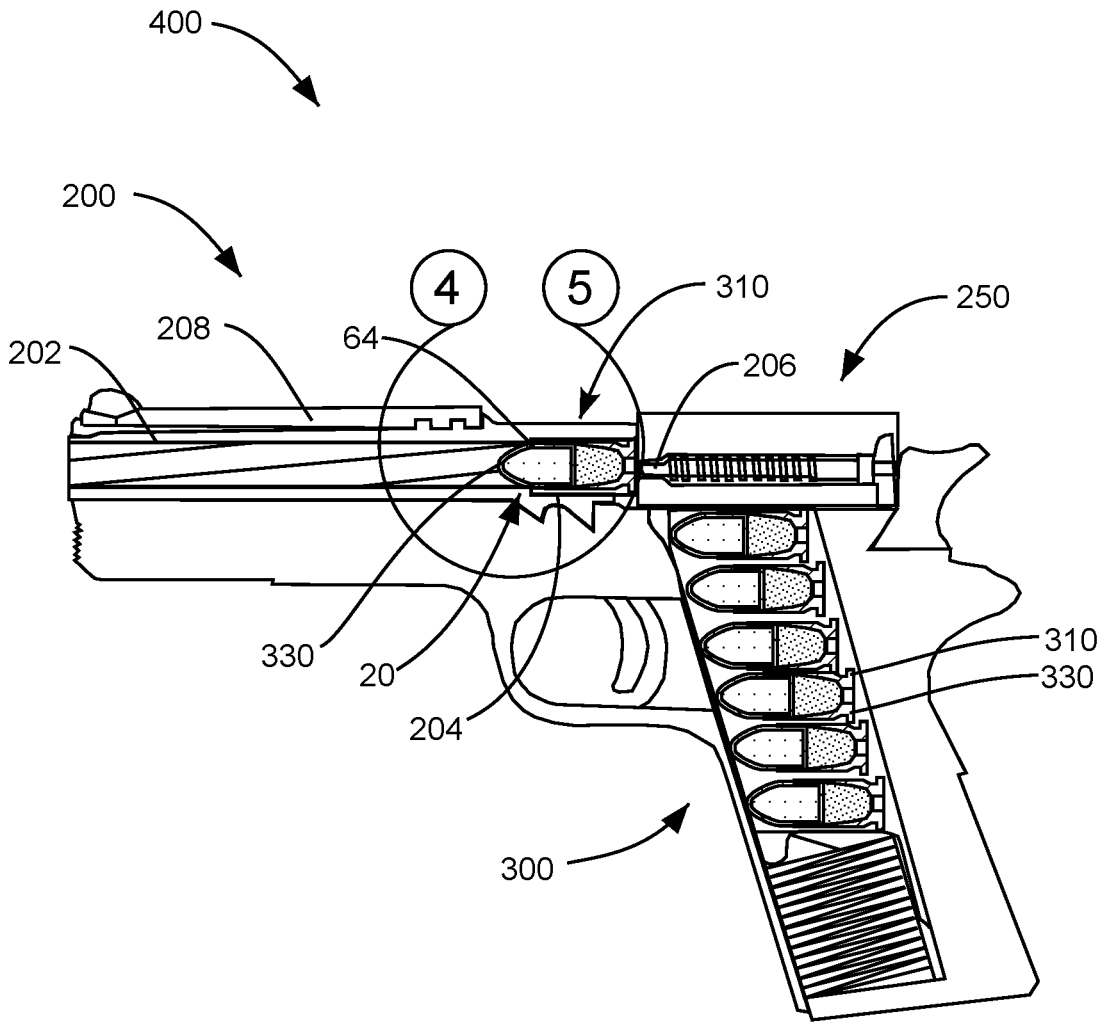
FIG. 3 is a cross sectional view of an ammunition system in accordance with another embodiment of the present invention shown with the ammunition system having a plurality of sub-mass projectiles disposed in a firearm ready for discharge.
Figure 4:
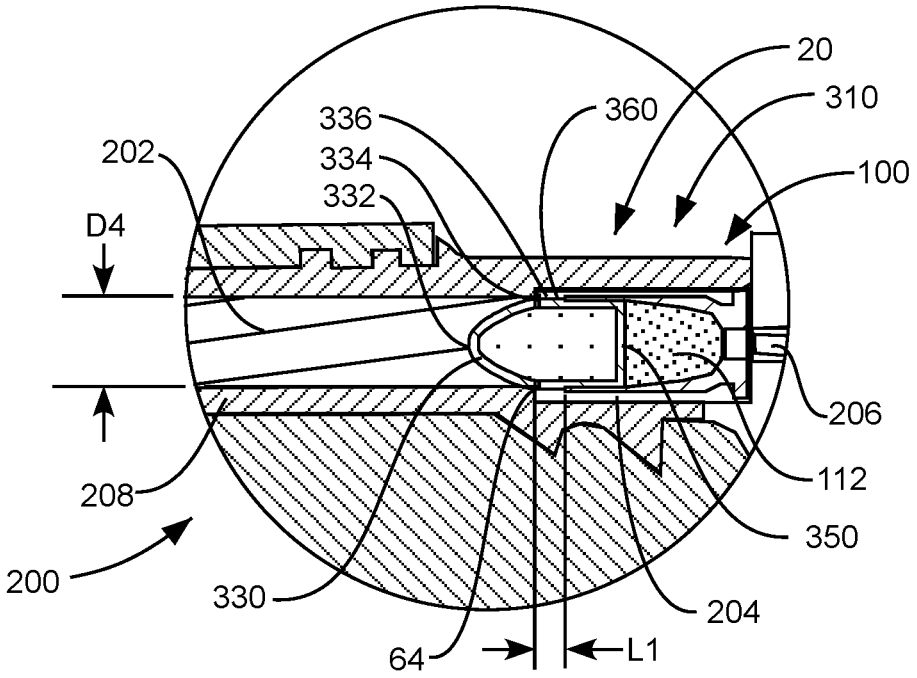
FIG. 4 is a cut-away view of a firing chamber of the firearm of FIG. 3 with one of the plurality of sub-mass projectiles disposed in the firing chamber.
Figure 5:
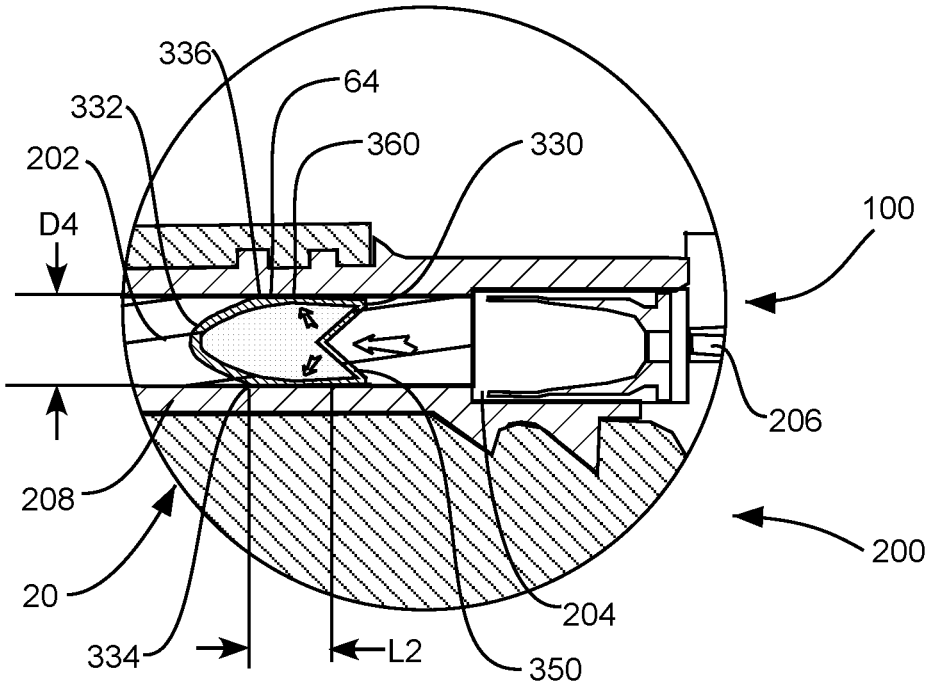
FIG. 5 is a cut-away view of a firing chamber of the firearm of FIG. 3 with one of the sub-mass projectiles in a discharged configuration in a barrel bore of the firearm.

More specifically, as best seen in FIGS. 3-5, the bearing surface 60 can form at least a portion of the outer surface 62 of the outermost diameter D1 of the projectile 10. The bearing surface 60 can be larger than an inner diameter D4 (FIG. 4) of a corresponding surface, such as a barrel bore 202, of the firearm, indicated generally at 200 (See FIG. 3). The greater sized diameter D1 of the sub-mass projectile 10 in the smaller sized diameter D4 barrel bore 202 can cause an increased resistive force between the firearm 200 and the sub-mass projectile 10 as the projectile moves along the barrel bore 202. The resistive forces can be frictional or drag forces between the barrel bore 202 and the projectile 10.

Additionally, the bearing surface 60 can form a seal 64 with the corresponding surface of the barrel bore 202 of the firearm 200 (FIG. 3). The seal 64 can help maintain combustion gasses from discharge of the firearm on a downstream or rearward end 12 of the sub-mass projectile 10 until sufficient pressure of the gasses is reached to overcome the increased resistive forces of the bearing surface 60 on the firearm, at which point the sub-mass projectile 10 is subsequently expelled from the firearm. The seal 64 can thus facilitate maximizing the propulsive forces of the discharge on the sub-mass projectile 10 within the barrel bore which further aids in preventing the sub-mass projectile 10 from seizing up within the barrel bore 202.

Together, the sub-mass, malleable material of the core 20 along with the oversized dimensions of the jacket, or the core 20 if no jacket is used, form a force inducer, indicated generally at 12. The force inducer 12 can include an interface, indicated generally at 14, that interacts with, creates and introduces forces into the firearm during operation of the firearm. The interface 14 can include the bearing surface 60 described above.

The force inducer is a combination or system of multiple characteristics and elements of the sub-mass projectile that work together during operation of the firearm to create the needed forces for the firearm to successfully discharge a sub-mass projectile 10. These physical characteristics and elements can include hardness, density, mass, weight, malleability, coefficient of friction, elasticity and plasticity of the materials used to form the core 20. The physical characteristics and elements can also include the geometric dimensions of the sub-mass projectile such as the oversize diameter and length of the bearing surface that is included in the interface 14. Together the material properties of the core and the geometry of the interface can be predetermined and designed work together to create and induce sufficient forces into the firearm via the interface 14 to cause the firearm to operate as if the firearm to operate as if the firearm was discharging a standard mass and size projectile.

Returning to FIGS. 1-2, the sub-mass malleable material of the jacket 30 and core 20 allow the oversized projectile 10 to move in the relatively smaller barrel bore without seizing up within the bore. Additionally, the malleable material of the jacket 30, or core 20 in the case where the projectile does not have a jacket, can have a predetermined hardness, density, and coefficient of friction with ferrous based materials as used in gun barrel bores. The hardness, density, and coefficient of friction of the jacket's 30 material can have sufficient magnitude to induce the desired operational kinetic forces via drag on the firearm, and yet be sufficiently low so as to not cause the sub-mass projectile 10 to bind up in the barrel bore 202.

Advantageously, the resistive forces generated by the bearing surface 60 not only have sufficient magnitude to approximate the operational kinetic forces of a standard mass projectile on the firearm 200 (FIG. 3) during operation but also allow firearm loading mechanisms, which generally rely on discharge and recoil forces of the firearm, to operate as if a standard mass projectile had been discharged from the firearm. In one aspect, the friction between the barrel bore 202 (FIG. 3) and the outer diameter D1 of the jacket 30 can simulate kinetic forces within the firearm generated by discharge of a standard projectile in the firearm needed to actuate an fully automatic loading action (not shown) of the firearm. In another aspect, the resistive forces between the barrel bore 202 (FIG. 3) and the outer diameter D1 of the jacket 30 can simulate kinetic forces within the firearm generated by discharge of a standard projectile in the firearm needed to actuate an semi-automatic loading action, indicated generally at 250, of the firearm 200. Such kinetic forces can include friction or drag of the sub-mass projectile, forces of recoil of the firearm as the sub-mass projectile is expelled from the firearm, and propulsive forces of the rapidly expanding discharge gasses dispersing behind the sub-mass projectile as the sub-mass projectile leaves the barrel of the gun.

An energetic material 112 can be disposed in the cartridge 100 adjacent the base 12 of the sub-mass projectile 10. The energetic material 112 can be configured to release and transfer propulsive energy to the sub-mass projectile 10 when the firearm is discharged. It is a particular advantage of the present invention that the energetic material 112, also known as a charge of the cartridge that is needed for firing the sub-mass projectile 10 does not need to be an overpressure charge or +P charge, as known in the art. Standard charge sizes are adequate for discharging the sub-mass projectile 10 and no further modification to either the cartridge 100, charge 112 or firearm 200 is necessary for successful operation of the firearm.

Thus, in use, when the firearm 200 is discharged, the resistive forces caused by the bearing surface 60 of the sub-mass projectile 10 can actuate an auto or semi-auto loading action of the firearm to cause another round of the sub-mass projectile ammunition to be loaded into the chamber of the firearm so that the gun is again ready for discharge. In this way, the sub-mass projectile 10 of the present invention can act in similar fashion to standard mass projectiles with respect to sequencing the firearm through repeated firing-loading-firing sequences.

As illustrated in FIGS. 3-7, a firearm system, indicated generally at 400, is shown in accordance with another embodiment of the present invention. The firearm system 400 is comprised of a firearm weapon, indicated generally at 200, and an ammunition system, indicated generally at 300. The ammunition system 300 can include a plurality of sub-mass projectiles 310 that can be similar in many respects to the sub-mass projectile 10 described above and shown in FIGS. 1-2. The plurality of sub-mass projectiles 310 can be loaded into a magazine 230 that can be inserted into an automatic (not shown) or semi-automatic loading mechanism, indicated generally at 250, the firearm 200, as known in the art. The projectiles 310 can include a core, indicated generally at 20 and described above. Additionally, the sub-mass projectiles 310 can include a deformable jacket, indicated generally at 330.

Figure 6:
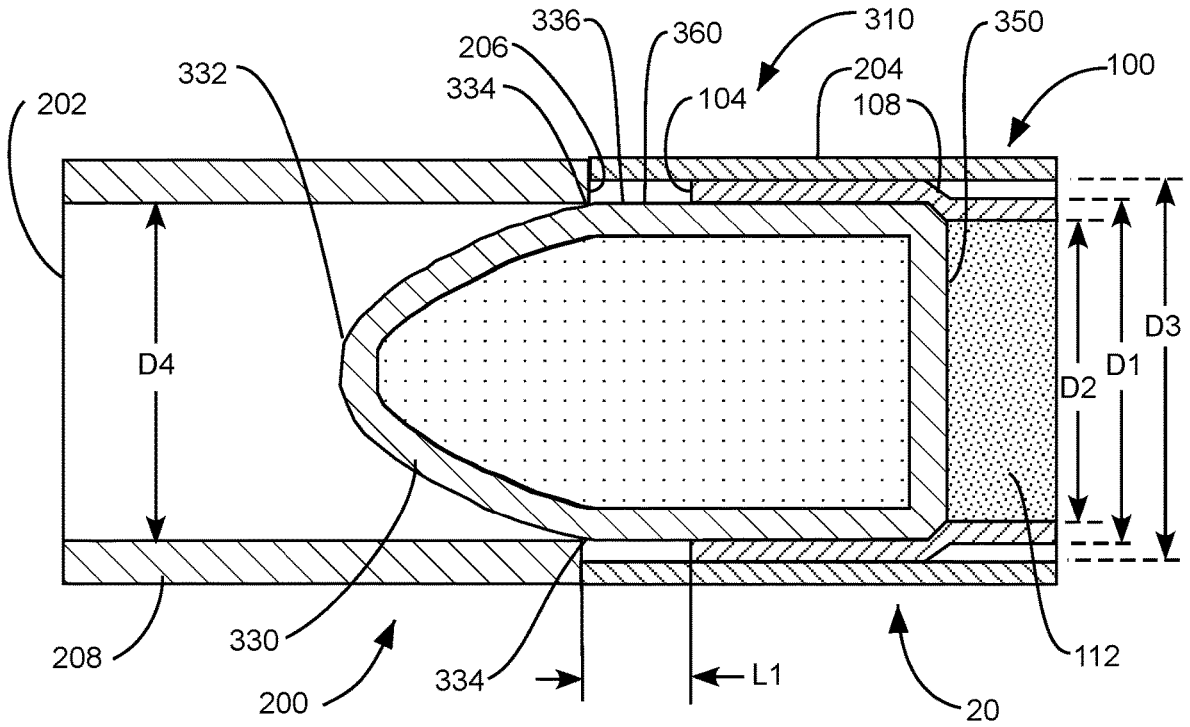
FIG. 6 is a cross sectional view of the sub-mass projectile of FIG. 3 in a pre-discharged configuration showing no deformation of a jacket and core of the sub-mass projectile.

As best seen in FIGS. 4 and 6, the deformable jacket 330 can encompass and enclose the core 20. The jacket 330 can have a similar general bullet or slug shape as the core 20 and can include a conical nose 332, a transition shoulder 334, and a cylindrical body 336. Additionally, the jacket 330 can mate with and couple to a cartridge 100. The cartridge 100 can fit within a firing chamber 204 of the firearm 200.

The jacket 330 can also have a bearing surface 360 that can contact and transfer loading and forces between the jacket and a barrel bore 202 of the barrel 208 of the firearm 200. The bearing surface 360 can be located beginning at the shoulder 334 and extend rearward a predetermined length L1 along the projectile 310.

The jacket 330 can have a malleable base 350 that can be deformed by explosive forces, indicated at arrow 370, of an energetic material that forms a charge 112 which is detonated by a firing pin 206 of the firearm 200. The deformation of the malleable base 350 of the jacket 330 can cause a corresponding deformation of the bearing surface 360. The deformation of the bearing surface 360 can cause greater forces, shown generally as arrows at 322 in FIG. 7, to be applied to the barrel bore 202 thereby increasing the resistive forces generated by the bearing surface 360 engaging the barrel bore 202 of the firearm 200.

Figure 7:
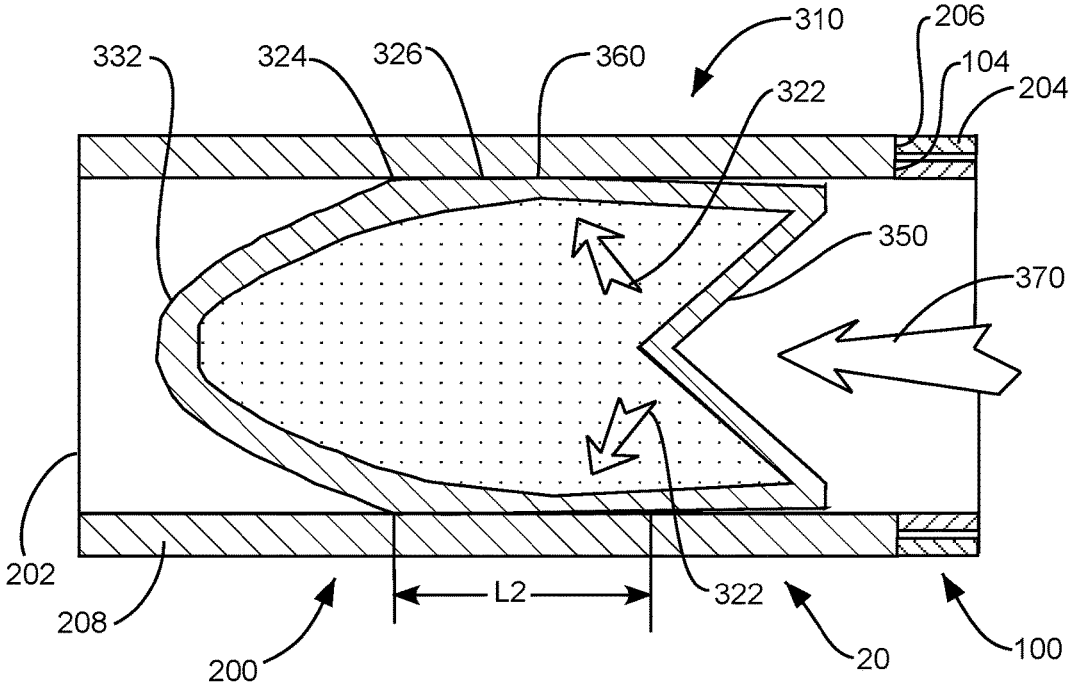
FIG. 7 is a cross sectional view of the sub-mass projectile of FIG. 3 in a post-discharged configuration showing deformation of a jacket and core of the sub-mass projectile.

Hence, the projectile 310 can have a bearing surface 360 that can be operably adjustable to resize upon operation of the firearm 200 such that the bearing surface 360 has a pre-fire configuration as seen in FIGS. 4 and 6, and a post-fire configuration as seen in FIGS. 5 and 7. In the pre-fire configuration, the projectile 310 and bearing surface 360 can be sized to fit within the firing chamber 204, auto-loading mechanism 250, and ammunition magazine 210 of the firearm 200 as best seen in FIG. 3. In the post-fire configuration the bearing surface 360 can be deformed to a size that increases an interference fit and seal with a corresponding contact surface, such as the barrel bore 202, within the firearm 200 so as to produce the desired pressure and resistive forces.

Together the malleable materials of the core along with the malleable jacket operate to induce forces in the firearm via the bearing surface that interfaces with the barrel bore of the firearm. The combination of the hardness, mass, density, and malleability of the core material along with the oversize diameter and length of the bearing surface of the jacket all operate together to create pressure and forces on and within the firearm during discharge of the firearm. Advantageously, the pressure and resistive forces created by the bearing surface 360 on the firearm 200 can approximate the operational kinetic forces of a standard mass projectile on the firearm 200. In this way, the firearm can operate as if the firearm were discharging standard mass projectiles when in fact the firearm is discharging sub-mass projectiles. Additionally, the firearm does not require any modification to the firearm or overpressure charge to shoot the sub-mass projectiles.

As best seen in FIG. 7, the deformation of the projectile 310 caused by the firing pin 206 can result in a deformation of the jacket 330 and more specifically deformation of the bearing surface 360 that increases the length of the bearing surface L1 to a relatively greater length L2 between the shoulder 334 and the original predetermined length L1 shown in FIG. 6. This increase in longitudinal length from L1 to L2 of the bearing surface 360 can result in an increase in area of engagement between the bearing surface 360 and the barrel bore 202. The increase in area of engagement in turn can result in an increase in friction between the sub-mass projectile 310 and the firearm 200. The increase in friction combined with build up of pressure from the discharge gasses behind the seal formed by the bearing surface 330 and the expulsion of the mass of the sub-mass projectile from the firearm can produce sufficient recoil and operational kinetic forces in the firearm such that the loading mechanism 250 of the firearm 200 can be actuated to reload another projectile 310 into the chamber 204 of the firearm 200.

As previously described, the deformation of the jacket 330 can deform the core 20 which in turn can transfer and apply greater forces, indicated generally at arrows 322, to the bearing surface 360 and against the barrel bore 202 of the firearm 200. In one aspect, the greater forces can be a pressure emanating from the core 20 to the bearing surface 360 of the jacket 330 to the barrel bore 202. Thus, as the core 20 is deformed the core presses radially outward against the barrel bore 202 causing greater resistive force between the sub-mass projectile 310 and the firearm 200. The greater magnitude forces represented by arrows at 322 applied from the core 320 to the bearing surface 360 can be transferred to the barrel bore 202 which can result in additional greater resistive forces that contribute to but are not solely caused by the increased area of engagement between the bearing surface 360 and the barrel bore 202 as the jacket is deformed by barrel geometry such as rifling and barrel bore diameter.

Although not shown, additional embodiments contemplate other geometric configurations of the bearing surface that would operationally and selectively adjust the resistive forces generated by the engagement of the bearing surface with the barrel. For example, instead of a full cylindrical bearing surface, the bearing surface can consist of a protrusion or plurality of protrusions extending radially outward from and spaced periodically around the core. The radial protrusions can contact the inner diameter of the barrel bore to act as the bearing surfaces. In this way, the size of the engagement face of the radial protrusions can be selectively adjusted with a smaller face producing less resistance and friction than a larger face.

Through combinations of changes in the mass of the sub-mass projectiles 310, deformation of the bearing surface 360, application of greater applied forces 322 to the bearing surface through the core 20, and manipulation of the engagement area L2 of the bearing surface 360, the user can select and better control desired operational performance characteristics of the sub-mass projectile 310. For example, velocity of the sub-mass projectile exiting the barrel 202 of the firearm 200 can be selectively adjusted by changing the mass of the core 20 and the outer diameter of the jacket 330. A sub-mass projectile 310 with a lower mass core and a relatively smaller sized outer diameter of the jacket 330 can be selected for a relatively faster exit velocity. Similarly, a sub-mass projectile 310 with a relatively higher mass and a relatively larger outer diameter of the jacket 330 can be selected for a relatively slower exit velocity. Hence, the exit velocity of the sub-mass projectile 10 and 310 can be adjusted to be within a range of a lethal exit velocity and non-lethal velocity.

As another example, projectile penetration into a target (not shown) of the sub-mass projectiles 10 and 310 can be selectively adjusted by changing the size of the outer diameter D1 of the bearing surface 60 and 360 such that the projectile has a greater interference fit within the barrel bore 202. Hence, a sub-mass projectile 10 and 310 with a relatively greater diameter bearing surface 60 and 360 can be selected for a relatively shallower target penetration and a sub-mass projectile with a relatively smaller diameter bearing surface can be selected for a relatively deeper target penetration.

Yet another exemplary operational performance characteristic of the sub-mass projectile that can be selectively adjusted by manipulation of the mass and dimensional characteristics of the sub-mass projectile is felt recoil force of the sub-mass projectile 10 and 310 on the firearm as the sub-mass projectile leaves the firearm. Hence, a sub-mass projectile 10 and 310 with a relatively greater sized bearing surface can produce a relatively higher felt recoil force and a sub-mass projectile with a relatively smaller sized bearing surface can produce a relatively lower felt recoil force. Additionally, a sub-mass projectile 10 and 310 with a relatively greater mass can produce a relatively higher felt recoil force and a sub-mass projectile 10 and 310 with a relatively smaller mass can produce a relatively lower felt recoil force. In either case, or by combination of adjustment of either or both mass and dimensional size, the recoil force can have sufficient magnitude to actuate an automatic loading mechanism of the firearm to allow rapid discharge of a plurality of sub-mass projectiles 10 and 310, and at the same time have a smaller felt recoil force magnitude to the user.

Still another unique operational characteristic of a sub-mass projectile 10 and 310 is that the malleability of the projectile can yield significant pressure reduction within the gas chambers of the barrel. It will be appreciated that standard projectiles such as lead slugs require greater pressures from the firearm to achieve maximum velocities and accuracy due to the hardness of the standard projectile material. In contrast, the sub-mass projectile can achieve greater accuracy with relatively minimal back pressures from the firearm compared to the pressures needed for harder and heavier projectiles, thus generating velocities that are greater than may even be possible for standard projectiles, while also achieving better accuracy and extending the life of the barrel and firearm.

Thus, operational performance characteristic of the sub-mass projectiles 10 and 310 can be selectively adjusted by changing the hardness, mass, density, malleability and dimensions of the sub-mass projectiles 10 and 310 either individually or in combination to achieve a desired performance. Exemplary performance characteristics that can be selectively adjusted include velocity of the sub-mass projectile as the sub-mass projectile exits from a barrel of the firearm, penetration depth of the sub-mass projectile on impact, cavitation of the sub-mass projectile in a target, kinetic energy of the sub-mass projectile during flight, accuracy of the trajectory of the sub-mass projectile during flight and impact on a target, and delivery of recoil forces to the firearm via the expulsion of the sub-mass projectile from the firearm can also be adjusted to a desired performance by selecting a sub-mass projectile with desired mass and dimensional characteristics.

Additionally, the present invention contemplates a method for making a sub-mass projectile for ammunition for a firearm including forming a sub-mass projectile having a nose, a base and a sidewall extending there-between from a material having relatively lower mass and density than a standard projectile for the firearm. A bearing surface can be formed on at least a portion of the sidewall. The bearing surface can be sized and shaped to engage a corresponding surface of the firearm to introduce resistive forces between the sub-mass projectile and the firearm. The resistive forces can have sufficient magnitude to approximate the recoil forces of a standard firearm projectile on the firearm during operation.

The present invention also contemplates a method for using a sub-mass projectile ammunition system in a firearm including selecting bullets with sub-mass projectiles having a bearing surface sized and shaped to produce a predetermined performance characteristic of the sub-mass projectile upon discharge of the firearm. A magazine can be loaded with the selected bullets. The firearm can be discharged to propel the sub-mass projectile and engage the bearing surface with a corresponding surface of the firearm to produce the desired predetermined performance characteristics in the sub-mass projectile.

Additionally, the loading action of the firearm can automatically reload a sub-mass projectile into a chamber of the firearm. The firearm can then be discharged a second time to propel a second sub-mass projectile and engage a bearing surface of the second sub-mass projectile with the corresponding surface of the firearm to produce the desired predetermined performance characteristics in the second sub-mass projectile.

The method of using the firearm can further include producing resistive forces in the firearm having sufficient magnitude to approximate the recoil forces of a standard firearm projectile on the firearm during operation, controlling a velocity of the projectile as the projectile exits from a barrel of the firearm, controlling a penetration depth of the projectile on impact with a target, and controlling kinetic energy generation of the projectile.

It is to be understood that the above-referenced arrangements are only illustrative of the application for the principles of the present invention. Numerous modifications and alternative arrangements can be devised without departing from the spirit and scope of the present invention. While the present invention has been shown in the drawings and fully described above with particularity and detail in connection with what is presently deemed to be the most practical and preferred embodiment(s) of the invention, it will be apparent to those of ordinary skill in the art that numerous modifications can be made without departing from the principles and concepts of the invention as set forth herein.

What is claimed is:

1. A sub-mass projectile for a standard, unmodified firearm, comprising:

a) a core having a relatively lower mass than a standard projectile for the standard, unmodified firearm, the core being substantially formed of a malleable nonmetal material deformable during operation of the firearm; and b) an outer surface associated with the core having a diameter that is sized less than an outer diameter of a standard cartridge and larger than an inner diameter of a standard, unmodified barrel bore of the standard, unmodified firearm; such that the outer surface associated with the core contacts the inner diameter of the standard, unmodified barrel bore to generate forces in the firearm that approximate operational forces of a standard mass projectile on the standard, unmodified firearm during operation.

2. The projectile of claim 1, the outer surface including:

a) a substantially smooth continuous bearing surface substantially surrounding the core that is sized and shaped to bear against a corresponding surface of the standard, unmodified firearm during operation of the standard, unmodified firearm to generate forces in the firearm; and b) wherein the forces have a magnitude sufficient to approximate operational forces of a standard mass projectile on the standard, unmodified firearm during operation.

3. The projectile of claim 2, wherein the substantially smooth continuous bearing surface is sized and shaped to provide a seal between the sub-mass projectile and the standard, unmodified firearm to keep combustion gasses from discharge of the standard, unmodified firearm downstream of the sub-mass projectile until sufficient pressure is reached to overcome the forces of the bearing surface on the standard, unmodified firearm, and the sub-mass projectile is subsequently expelled from the standard, unmodified firearm.

4. The projectile of claim 1, wherein the relatively lower mass of the sub-mass projectile is between approximately 30 to 70 percent less mass than a standard projectile's mass.

5. The projectile of claim 1, wherein the outer surface includes a smooth continuous bearing surface having a relatively larger uniform diameter than a diameter of a corresponding surface of the standard, unmodified firearm; and wherein the relatively larger diameter of the bearing surface is between approximately 0.0001" and 0.005" larger than the outer diameter of a standard projectile.

6. The projectile of claim 1, further comprising:

a jacket encompassing the core and wherein the outer surface is formed by the jacket.

7. The projectile of claim 6, wherein the jacket is formed of a malleable metallic material selected from the group consisting of copper, brass, lead, tin, aluminum, and combinations thereof.

8. The projectile of claim 6, wherein the jacket further includes a malleable base deformable upon discharge of the standard, unmodified firearm and resulting in a corresponding deformation of the core such that the core applies forces to the outer surface which increase forces between the projectile and the firearm.

9. The projectile of claim 1, wherein the core includes a malleable material selected from the group consisting of wax, PVC, CPVC, ABS, polymers, esters, plastic, resin, thermoplastic, rubber, silica, glass, zirconium, diamond, polyethylene, ethylene, lime, concrete, cement, aggregate materials, metal powders, metal fragments, CO2, copper diffused ABS, and combinations thereof.

10. An ammunition system for a standard, unmodified firearm, comprising:

a) a sub-mass projectile having a relatively lower mass than a standard projectile for the standard, unmodified firearm, the sub-mass projectile further comprising:

i) a nose disposed on a forward end of the sub-mass projectile;

ii) a base disposed on a rearward end of the sub-mass projectile;

iii) a shoulder disposed between the nose and the base;

iv) a sidewall extending cylindrically between the shoulder and the base;

v) a selectably sized substantially smooth continuous bearing surface associated with at least a portion of the sidewall, the smooth continuous bearing surface having a substantially uniform diameter from the shoulder to the base, the diameter being relatively larger than an outer diameter of a standard size and mass projectile for the firearm, the diameter size being selected to engage with the standard, unmodified firearm when the standard, unmodified firearm is discharged to create a resistive force on the standard, unmodified firearm and to facilitate a buildup of a backpressure within the standard, unmodified firearm on the sub-mass projectile, the resistive force and backpressure having sufficient magnitude to determine an operational performance characteristic of the sub-mass projectile as the projectile exits a barrel of the standard, unmodified firearm;

b) a standard cartridge sized and shaped according to a standard cartridge size for the standard, unmodified firearm, and having an outer diameter relatively larger than the bearing surface of the sub-mass projectile, the standard cartridge being disposable around the bearing surface of the sub-mass projectile; and c) an energetic material disposed in the standard cartridge adjacent the base of the sub-mass projectile, the energetic material forming a charge for the standard, unmodified firearm.

11. The system of claim 10, wherein the operational performance characteristic is velocity of the sub-mass projectile as the projectile exits a barrel of the firearm; and wherein a sub-mass projectile with a relatively greater sized bearing surface produces a relatively slower exit velocity and a sub-mass projectile with a relatively smaller sized bearing surface produces a relatively faster exit velocity.

12. The system of claim 11, wherein the sub-mass projectile includes a core having a relatively lower mass than a standard projectile for the standard, unmodified firearm, and the core is substantially formed of a malleable nonmetal material deformable during operation of the firearm to increase friction between the sub-mass projectile and the standard unmodified firearm.

13. The system of claim 10, wherein the operational performance characteristic of the sub-mass projectile is selected from the group consisting of velocity of the sub-mass projectile as the sub-mass projectile exits from a barrel of the standard, unmodified firearm, penetration depth of the sub-mass projectile on impact, cavitation of the sub-mass projectile in a target, kinetic energy of the sub-mass projectile during flight, accuracy of the trajectory of the sub-mass projectile during flight and impact on a target, and delivery of recoil forces to the firearm via the expulsion of the sub-mass projectile from the standard, unmodified firearm.

14. The system of claim 10, wherein the operational performance characteristic of the sub-mass projectile is felt recoil force of the sub-mass projectile on the standard, unmodified firearm as the sub-mass projectile leaves the standard, unmodified firearm; and wherein a sub-mass projectile with a relatively greater sized bearing surface produces a relatively higher recoil force and a sub-mass projectile with a relatively smaller sized bearing surface produces a relatively lower recoil force.

15. The system of claim 14, wherein the recoil force has sufficient magnitude to actuate a standard, unmodified loading mechanism of the standard, unmodified firearm to allow rapid discharge of a plurality of sub-mass projectiles.

16. A firearm system, comprising:

a) a standard, unmodified firearm configured to fire standard size and mass projectiles per a pre-determined caliber of the firearm, the standard, unmodified firearm further comprising:

i) a standard, unmodified chamber sized and shaped to receive standard size and mass projectiles; and ii) a standard, unmodified barrel configured to receive and discharge standard size and mass projectiles;

b) an ammunition system operably engageable with the standard, unmodified firearm including a sub-mass projectile, comprising:

i) a deformable substantially nonmetal core having a relatively lower mass than a standard projectile for the standard, unmodified firearm;

ii) a substantially smooth uniform bearing surface associated with the core and having a relatively larger outer diameter than an outer diameter of a standard projectile for the standard, unmodified firearm; and iii) a standard cartridge sized and shaped to the caliber of the standard, unmodified firearm and the core being disposable within the standard cartridge with an outer diameter relatively larger than the outer diameter associated with the core;

iv) an energetic material disposed in the standard cartridge near the core, the energetic material forming a charge for the standard, unmodified firearm to propel and discharge the core from the firearm; and c) the bearing surface being sized and shaped to increase resistive forces between the sub-mass projectile and the standard, unmodified barrel, and to seal the standard, unmodified barrel to allow pressure from the charge to increase in the standard, unmodified chamber until the pressure overcomes the resistive forces and the sub-mass projectile is expelled from the standard, unmodified firearm.

17. The system of claim 16, wherein the resistive forces between the sub-mass projectile and the standard, unmodified firearm have sufficient magnitude to create recoil forces in the standard, unmodified firearm that actuate a standard, unmodified automatic loading mechanism of the standard, unmodified firearm.

18. The system of claim 16, wherein the resistive forces between the sub-mass projectile and the standard, unmodified firearm have sufficient magnitude to create recoil forces in the standard, unmodified firearm that actuate a semi-automatic loading mechanism of the standard, unmodified firearm.

19. The system of claim 16, the ammunition system further comprising a plurality of sub-mass projectiles.

20. The system of claim 19, wherein the resistive forces between the sub-mass projectile and the standard, unmodified barrel have sufficient magnitude to create recoil forces in the standard, unmodified firearm that actuate an automatic loading mechanism of the standard, unmodified firearm to allow rapid discharge of each of the plurality of sub-mass projectiles of the ammunition system.

* * * * *